United States Patent [19]

Harris

[11] Patent Number: 4,947,996

[45] Date of Patent: Aug. 14, 1990

[54] UNITARY ARTICLE HOLDER/DISPLAY

[76] Inventor: Howard J. Harris, 860 Lafayette St., Denver, Colo. 80218

[21] Appl. No.: 191,686

[22] Filed: May 9, 1988

[51] Int. Cl.[5] ..... A47F 7/00

[52] U.S. Cl. ..... 211/50; 211/73

[58] Field of Search ..... 211/50, 73, 42, 132; 229/27, 2.5; 248/174, 459

[56] References Cited

U.S. PATENT DOCUMENTS

| | | | |
|---|---|---|---|
| 1,054,487 | 2/1913 | Bagley | 211/60.1 X |
| 1,614,265 | 1/1927 | Stockton | 211/73 X |
| 1,836,138 | 12/1931 | Turner et al. | 211/73 X |
| 1,896,677 | 2/1933 | Myers | 211/73 |
| 3,586,279 | 6/1971 | Benson | 211/73 X |
| 3,751,172 | 8/1973 | Seitz et al. | 211/73 X |

*Primary Examiner*—Alvin C. Chin-Shue
*Assistant Examiner*—Sarah A. Lechok
*Attorney, Agent, or Firm*—John E. Reilly

[57] ABSTRACT

A holder display for articles, such as pamphlets, brochures, and the like is formed out of a plastic or paperboard sheet and is foldable into a generally triangular section which defines a base panel, back panel and inclined support portion, and a front pocket is united with the triangular section to define a front panel, side panel and forward extension of the base panel for insertion of the articles into the front pocket section so as to rest against the inclined support of the triangular section.

10 Claims, 2 Drawing Sheets

UNITARY ARTICLE HOLDER/DISPLAY

This invention relates to article holders and more particularly to a novel and improved holder for holding and displaying pamphlets, brochures and the like in an upright position on a table or countertop.

BACKGROUND AND FIELD OF INVENTION

Numerous types of article holders or displays have been devised for displaying loose leaf paper materials, such as, newspapers, advertising brochures and pamphlets to the public. For example, it is customary in retail stores, banks and other establishments to provide handouts to customers in the form of elongated, pocket-sized brochures which in many cases are loosely stacked on counter tops or tables. However, it is desirable to provide for standup displays either for a counter top or which can be wall-mounted so that the brochures can be easily inserted into and removed from a pocket or opening in the display by the customer and at the same time is fully visible to the customer and provides an attractive display. Moreover, it is desirable that the display itself is able to bear any appropriate advertising, will afford a firm support for the articles to be displayed and yet is both low cost and compact.

Among approaches taken in the past as a solution to this problem, U.S. Pat. No. 3,392,903 to Morgan, Jr. discloses a foldable hang-up display and utility receptacle which can be set up from a one piece blank of plastic material into a pocket panel structure which can be assembled without the use of special tools or fasteners. However, Morgan is concerned more with providing one or more pockets in a single display and not concerned so much with supporting brochures and pamphlets of pocket-sized, elongated generally rectangular configuration and in such a way as to afford utmost visibility of the printed material on the article.

Other approaches have been taken to fabrication of blanks of sheet-like material which can be shipped in a flat condition and easily assembled by folding along creases or fold lines into upright displays, such as, for the purpose of displaying newspapers as in U.S. Pat. No. 3,903,789 to Hurley, or web-like material as represented by U.S. Pat. No. 4,482,052 to Wischusen. U.S. Pat. No. 4,630,731 to Albery discloses another approach to a foldable display which can be assembled out of a unitary blank of material and intended to be used as a brochure holder and which features a bottom panel which slopes forwardly along the bottom surface of the pocket for the brochures so as to encourage the brochures to remain upright and be as visible as possible.

SUMMARY OF THE INVENTION

It is an object of the present invention to provide for a unitary holder/display for pamphlets which is lightweight and compact but of sturdy construction.

Another object of the present invention is to provide for a unitary holder/display for pamphlets and the like which can be formed from a blank of plastic or paperboard material and folded into a sturdy holder for supporting articles in an upright position in the holder.

A further object of the present invention is to provide an article holder/display which can be formed into different sizes to accommodate different sized articles and which is specifically adaptable for use as a counter display.

A still further object of the present invention is to provide for a plurality of counter displays for articles, such as, pamphlets, brochures and the like in which a plurality of displays may be interconnected in side-by-side, mutually reinforcing relation to one another.

An additional object of the present invention is to provide for an article holder for supporting and displaying articles in the form of loose leaf materials which can be stacked in vertical disposition in the holder and wherein the holder itself is conformable for use either as a counter top or wall-mounted display for pamphlets, brochures and the like; and further wherein the display or displays can be shipped in a flat condition and assembled at the point of use without need for any tools or fasteners.

In accordance with the present invention, there has been devised an article display which is specifically adaptable for use in supporting loose leaf pamphlets, brochures and the like in an upright position so that they are readily visible to customers or potential customers as a counter top or wall-mounted display, the holder comprising a unitary sheet of material foldable into a front pocket section and rear support section, the front pocket section having a generally rectangular front panel, a first or forward bottom panel and opposite side panels extending rearwardly from said front panel; the rear support section is of generally triangular configuration including a forward support panel inclining upwardly and rearwardly from said forward bottom panel, a rear vertical support panel and a rearward bottom panel extending horizontally between lower edges of said support panels. The forward inclined support panel defines a rearward inclined wall surface of an upwardly directed opening or pocket formed between that wall surface, the front panel and opposite side panels for insertion of articles therein, the opposite side panels extending rearwardly from the front panel along opposite sides of the rear support section and including first fastener means for securing the side panels to the rear support panel, and second fastener means between the front and rear bottom panels whereby to complete the assembly of the article holder structure.

The above and other objects, advantages and features of the present invention will become more readily understood from the following detailed description of a preferred embodiment thereof when taken together with the accompanying drawings, in which:

DETAILED DESCRIPTION OF THE PREFERRED EMBODIMENT

Figure 1:
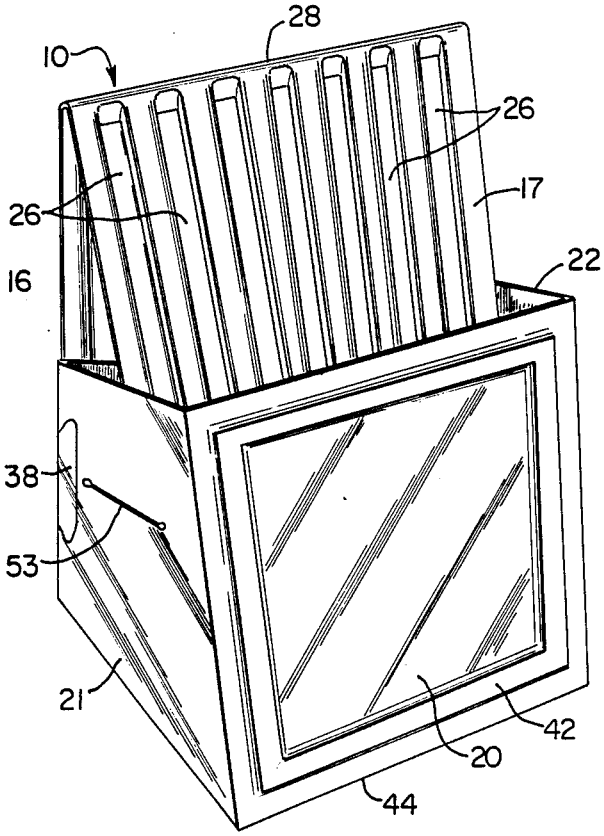
FIG. 1 is a perspective view of a preferred form of article holder/display in accordance with the present invention.
Figure 2:
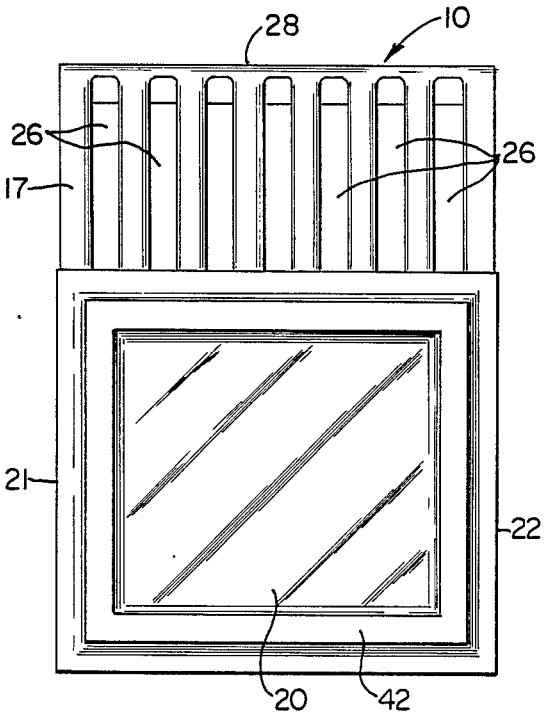
FIG. 2 is a front elevational view of a preferred form of invention.
Figure 3:
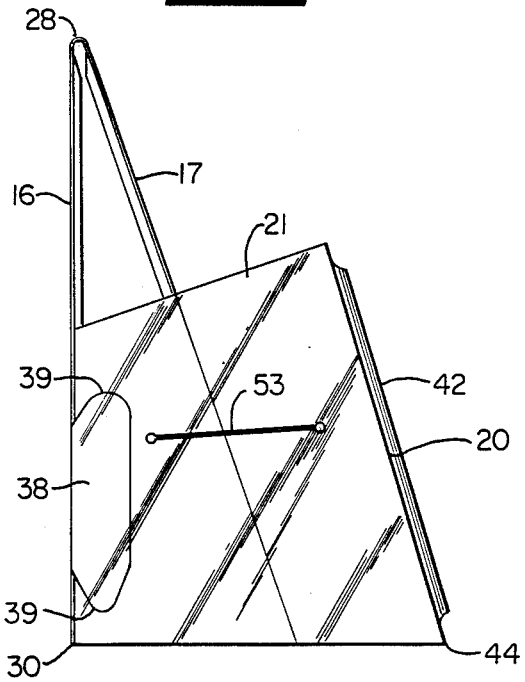
FIG. 3 is a side view of a preferred form of holder in accordance with the present invention.
Figure 4:
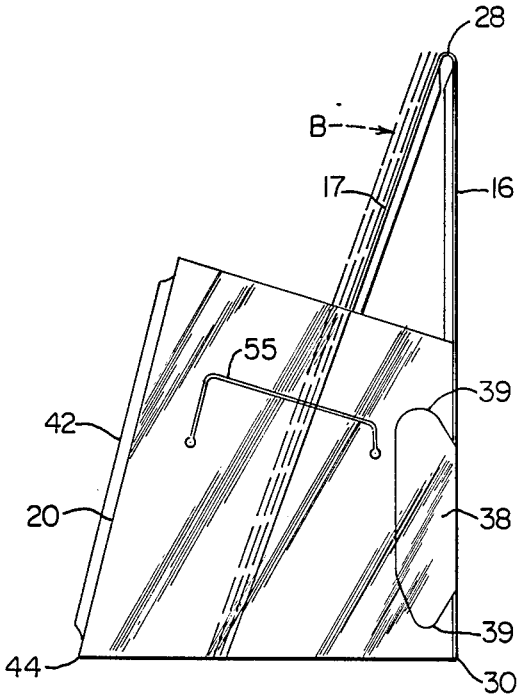
FIG. 4 is an opposite side view to that of FIG. 3 of the preferred form.
Figure 5:
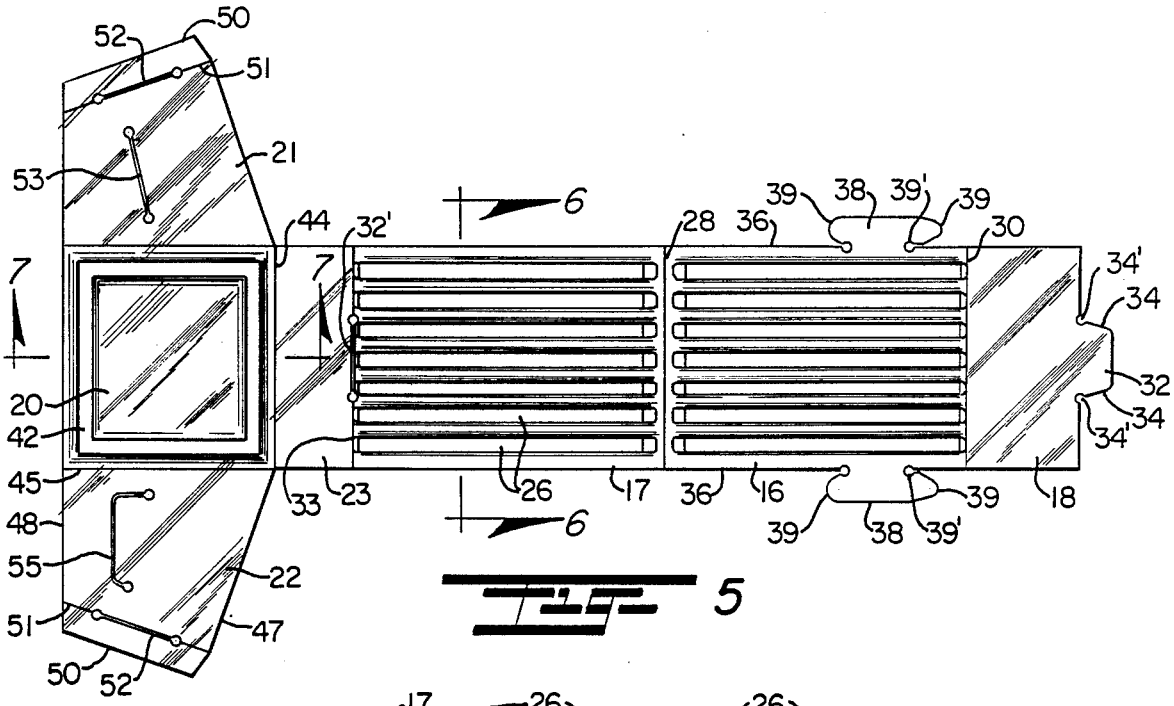
FIG. 5 is a plan view of a blank of material illustrating the necessary creases, score lines and ribs as a preliminary to folding into a holder/display.
Figure 6:
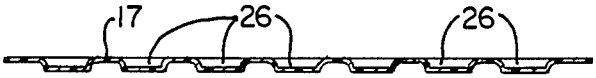
FIG. 6 is a cross-sectional view taken about lines 6—6 of FIG. 5.
Figure 7:
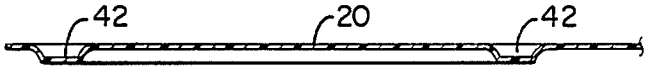
FIG. 7 is a cross-sectional view taken about lines 7—7 of FIG. 5.
Figure 9:
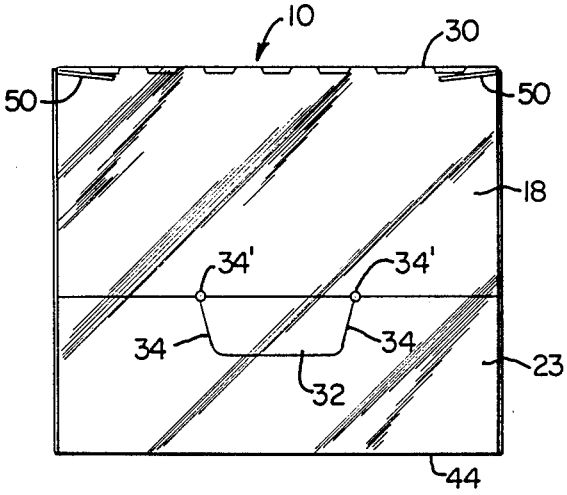
FIG. 9 is a bottom plan view of a preferred form of holder/display.
Figure 8:
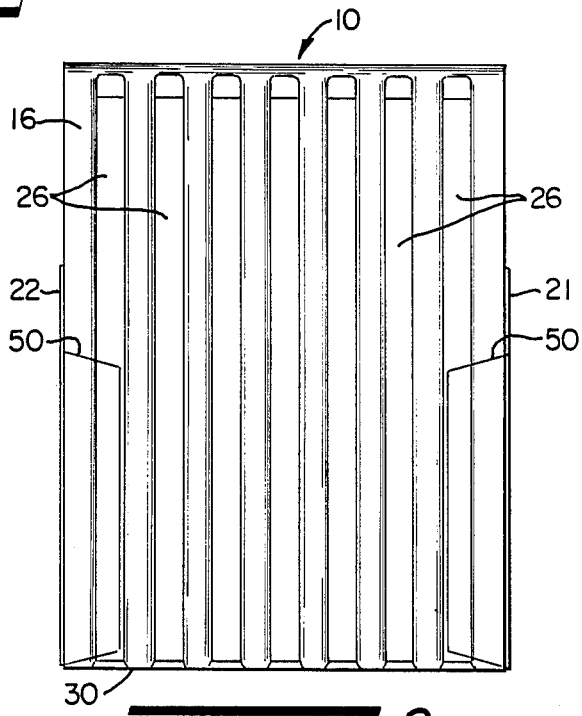
FIG. 8 is a rear view and elevation of the preferred form of holder/display.

Referring in more detail to the drawings, there is illustrated in FIGS. 1 to 9 a preferred form of holder/-display unit 10 which is specifically adaptable for use as a holder for pamphlets or brochures as generally designated at B in FIG. 4. In this particular form, the holders are dimensioned for the supporting and display of elongated, rectangular pamphlets in a substantially upright position on a counter or other table top, for example, to facilitate removal by a customer or potential customer. Referring in particular to FIGS. 1 and 5, the holder/display unit 10 is preferably comprised of a blank of clear plastic material having or being selectively creased or scored so that it can be manually folded from a flat sheet S as illustrated in FIG. 5 into the assembled or folded configuration of FIG. 1.

In the folded condition of FIG. 1, the unit 10 is broadly comprised of a generally triangular rear section 12 and a front pocket section 14. The section 12 includes a back vertical support panel 16, a front upwardly and rearwardly inclined support panel 17 and a bottom panel 18. In turn, the section 14 includes a front panel 20, opposite side panels 21 and 22 and a bottom panel 23 which in a manner to be described is aligned with the bottom panel 18 of the rear section 12. Moreover, the inclined panel 17 defines a rear surface of the pocket section 14 whereby the brochures B when stacked in the front pocket section will have bottom edges resting against the bottom panel 23 and be tilted rearwardly against the inclined panel 17.

Considering in more detail the preferred construction and arrangement of the unit 10, it will be seen from FIGS. 5 to 9 that each panel 16 and 17 has spaced longitudinal ribs 26 which extend for the substantial length of each of the panels 16 and 17 and are discontinued or separated at their adjacent ends by a fold line 28 which extends across the entire width of the blank. Another fold line 30 extends across the width of the blank at one end of the panel 16 to divide it from the bottom panel 18, and a tab 32 extends from one end of the bottom panel having beveled or tapered side edges 34 and undercut portions 34'. The tab 32 is dimensioned for close fitting insertion into a transverse slot 32' formed intermediately of fold line 33 at the intersection of the panel 17 with the bottom panel 23. When the panels 16 and 17 are folded into an inverted, generally V-shaped configuration, as shown in FIGS. 1 to 4, and the panel 18 is folded beneath the panels 16, 17 such that the tab 32 extends forwardly into alignment with the slot 32', the tab can then be advanced or inserted horizontally into the slot 32' until the undercut portions 34 clear or are caught by the edges of the slot 35 to retain the tab 32 in position.

The panel 16 is also provided with laterally extending tabs 38 on opposite side edges 36 of the panel, each tab 38 having opposite ends 39 projecting beyond the imaginary line of intersection 40 with edge 36. Preferably, each end 39 is undercut at 39' as shown to facilitate connection to one of the side panels 21 and 22 in a manner to be described.

In the blank as illustrated in FIG. 5, the front section 14 is a coplanar extension of the rear section 12, the front panel 20 being square and an integral extension from one edge of the bottom panel 23. Preferably, a generally rectangular rib 42 is embossed out of the outer periphery of the panel 20 to rigidify the panel 20 to some extent and to form a border for suitable advertising or identifying materials, not shown, which can be placed within the border 42. The panel 20 is foldable upwardly about an imaginary line of intersection or fold line 44 between the panels 20 and 23 so that the panel 20 can be folded into the rearwardly inclined disposition or attitude shown in FIGS. 1, 3 and 4.

The opposite side panels 21 and 22 also define coplanar lateral wings or extensions of the panel 20 from opposite side edges 45. Each side panel 21 and 22 has an inclined longer edge 47 and a shorter edge 48, the edges 47 and 48 terminating in a common outer free edge 50. Each side panel 21 and 22 is provided with a corresponding slot 52 disposed in closely spaced parallel relation to an outer free edge 50. In addition, one side panel 21 is provided with a slot 53 substantially at right angles to the slot 52, and side panel 22 includes an intermediate slot 55 which is of generally U-shaped configuration so as to effectively form a tab or tongue out of the wall thickness of the panel. The slots 53 and 55 are complementary to one another in the respect that when adjacent holders are placed in side-by-side relation to one another, the tab portion 55 in one side panel 22 can be inserted into a slot 53 of an adjoining side panel 21 of an adjacent holder.

The front pocket section as described completes the assembly of the holder by folding the front panel 20 upwardly about the line of intersection 44 with the panel 23 and folding the side panels 21 and 22 rearwardly about the lines 45 with the front panel. Assuming that the rear section has been folded as described, the side panels when folded rearwardly will have their slots 52 brought into registry with the tabs 38. The tabs 38 are formed as previously described so that it is necessary to tilt the side panels slightly to permit insertion of a lower end 39 of each tab into the slot prior to insertion of the rest of the tab, since the length of the slot 52 is made to be slightly less than the overall length of the tab 38. Most desirably, a crease or fold line 51 is formed as an extension of the slot 52 so that portion of the panel outwardly of the slot 52 can be folded or bent inwardly so as to bear against the inner surface of the panel 16 when the tab 38 is inserted into the slot. It should be noted that the positive connection of the tabs 38 will assist in retaining the tab 42 within the slot 35; also, that the panels 16 and 17 when folded into triangular configuration will project substantially above the upper edge of the pocket section. The edges 48 of the panels 21 and 22 will form rearwardly and downwardly inclined upper edges of the pocket along opposite sides of the triangular support section and together with the front panel define a generally box-shaped receptacle for the insertion and support of pamphlets or brochures.

It will be evident from the relationship described that the holder unit 10 is readily conformable for use either as a counter top display or, by virtue of the perpendicular relationship between the rear panel 16 and bottom panel 18, may be wall-mounted. Wall-mounting can be accomplished in any well known manner, such as, by inserting a fastener through the wall thickness of one or both of the panels 16 and 17 into the wall itself. In forming the holder out of a blank of material as illustrated in FIG. 5, various commercially available plastic or paperboard materials may be employed. However, it is preferable to use a plastic, such as, a vinyl material which lends itself well to vacuum forming. In this way, the blanks may be stacked and shipped flat to the intended point of use or sale. The blanks may then simply be stored in that position until desired to use for display purposes. It will be apparent that that relative dimensions of the support panels 16 and 17 with respect to the front pocket sections 14 may be made in accordance with the length and type of pamphlet or other material to be displayed. However, a particular advantage of the present invention is the ability to modify the size and proportions to conform to different display items; also to permit upward projection and support of elongated rectangular loose leaf materials so as to be more readily visible to the eye.

It is therefore to be understood that various modifications and changes may be made in the construction and arrangement of parts comprising the present invention without departing from the spirit and scope thereof as defined by the appended claims.

I claim:

1. An article holder for receiving and displaying loose leaf materials, such as, pamphlets and the like, said holder comprising a unitary sheet of material which is foldable from a flat condition into an upstanding front pocket section and a rear support section, said front pocket section having a generally rectangular, upright front panel, a horizontal bottom panel and opposite upright side panels extending rearwardly from said front panel; said rear support section foldable into a generally triangular configuration including a pair of upright support panels having a first common fold line therebetween and a rear bottom panel extending horizontally between said support panels, said side panels extending rearwardly from said front panel along opposite sides of said support panels including first connecting means for connecting said side panels to said rear support section, said front and rear bottom panels terminating in free edges in confronting relation to one another and second securing means along said free edges of said bottom panels for securing said bottom panels together.

2. An article holder according to claim 1, one of said support panels of said rear support section inclining upwardly and rearwardly to define a rear wall of said front pocket section.

3. An article holder according to claim 1, said front, side and bottom panels of said pocket section adjoining one another, there being a common adjoining edge between each of said side panels and an opposite side of said front panel and a common adjoining edge between said front bottom panel and lower edge of said front panel.

4. An article holder according to claim 1, said rear support section foldable from a flat sheet in which said support panels and rear bottom panels are joined in end-to-end relation into a generally triangular configuration in which said support panels have said first common fold line along upper adjoining edges of said inclined panels and a second common fold line between a lower edge of said rearward support panel and said bottom rear panel.

5. An article holder according to claim 1, said front panel and said front inclined panel extending in substantially parallel relation to one another and defining with said opposite side panels a common, upwardly directed opening for insertion of articles therein.

6. An article holder for receiving and displaying a plurality of loose leaf materials in upright, stacked relationship to one another wherein said holder is made up of a front pocket section and rear support section, the improvement comprising:

said pocket section having an upright front panel provided with top and bottom horizontal edges and opposite, vertically extending side edges, a bottom panel extending rearwardly and horizontally from said bottom horizontal edge, and opposite side panels extending rearwardly from said opposite side edges to define with said front panel an upwardly directed article receiving opening therein; and said rear support section having a front, rearwardly inclined support panel and a rear vertically extending support panel, said front support panel inclining upwardly and rearwardly from said bottom panel in rearwardly spaced, substantially parallel relation to said front panel, said front inclined support panel joined at an upper horizontal edge with an upper horizontal edge of said rear vertical support panel, said front and rear support panels projecting upwardly a substantial distance above said upper horizontal edge of said front panel, said front support panel defining a rear wall surface of said opening such that said articles are insertable into said opening so as to rest in stacked relationship against said front support panel and to project a substantial distance above said front panel so that at least a substantial portion of a front surface of said articles is visible above said front panel, said front and rear support panels being of a width substantially corresponding to the width of said front panel, and securing tabs on opposite side edges of said rear support panel insertable through slits in said opposite side panels.

7. An article holder according to claim 6, a rear bottom panel portion extending between said front and rear support panels including a securing tab inserted through a slit in said front bottom panel portion at the juncture between said front bottom panel and said front support panel.

8. An article holder according to claim 7, said front and rear support panels having vertical ribs extending longitudinally of each said support panel in closely spaced relation to one another.

9. An article holder according to claim 6, including a plurality of article holders, each holder having complementary tabs and slots in opposite side panels, the tab in one side panel being connectable to a slot in an adjoining side panel of an adjacent article holder for interconnection of said article holders in side-by-side relation.

10. A plurality of article holders for receiving and displaying loose leaf materials, such as, pamphlets and the like, each said holder comprising a unitary sheet of material which is foldable from a flat condition into an upstanding front pocket section and a rear support section, said front pocket section having a generally rectangular, upright front panel, a horizontal bottom panel and opposite upright side panels extending rearwardly from said front panel; said rear support section foldable into a generally triangular configuration including a pair of upright support panels and a rear bottom panel extending horizontally between said support panels, said side panels extending rearwardly from said front panel along opposite sides of said support panels including first connecting means for connecting said side panels to said rear support section, said front and rear bottom panels terminating in free edges in confronting relation to one another and second securing means along said free edges of said bottom panels for securing said bottom panels together, each said holder having complementary tabs and slots in opposite side panels, the tab in one side panel being connectable to a slot in an adjoining side panel of an adjacent article holder for interconnection of said article holders in side-by-side relation.

* * * * *